US009365319B2

(12) United States Patent
Hennemann et al.

(10) Patent No.: US 9,365,319 B2
(45) Date of Patent: Jun. 14, 2016

(54) CONTAINER, IN PARTICULAR A WIDE-MOUTHED JAR, FOR CONTAINING A LIQUID OR PASTY MATERIAL AND COMBINED WITH A SYSTEM FOR COLLECTING AND DISPENSING WITHOUT TAKING IN AIR

(71) Applicant: Promens SA, Bellignat (FR)

(72) Inventors: Pascal Hennemann, Vaux les Saint Claude (FR); Jesus Reyes Serrato, Igualada (ES); Jaume Tobias Franco, Palleja (ES)

(73) Assignee: PROMENS SA, Bellignat (FR)

( * ) Notice: Subject to any disclaimer, the term of this patent is extended or adjusted under 35 U.S.C. 154(b) by 0 days.

(21) Appl. No.: 14/382,666

(22) PCT Filed: Feb. 6, 2013

(86) PCT No.: PCT/FR2013/050249

§ 371 (c)(1),
(2) Date: Sep. 3, 2014

(87) PCT Pub. No.: WO2013/153297

PCT Pub. Date: Oct. 17, 2013

(65) Prior Publication Data

US 2015/0021331 A1 Jan. 22, 2015

(30) Foreign Application Priority Data

Mar. 15, 2012 (FR) ..... 12 52358

(51) Int. Cl.
*B65D 25/16* (2006.01)
*B05B 11/00* (2006.01)
*B65D 83/00* (2006.01)

(52) U.S. Cl.
CPC ..... *B65D 25/16* (2013.01); *B05B 11/0045* (2013.01); *B65D 83/0055* (2013.01)

(58) Field of Classification Search
CPC . B65D 25/16; B65D 83/0055; B05B 11/0045
USPC ..... 220/495.06; 222/95, 209
See application file for complete search history.

(56) References Cited

U.S. PATENT DOCUMENTS 5,417,258 A 5/1995 Privas
5,454,896 A * 10/1995 Harding et al. ..... 156/156

(Continued)

FOREIGN PATENT DOCUMENTS

EP 0 505 611 11/1991
EP 0 546 898 4/1996

(Continued)

OTHER PUBLICATIONS

PCT/FR2013/050249 International Search Report dated May 31, 2013 (4 pages including English translation).

(Continued)

*Primary Examiner* — Fenn Mathew
*Assistant Examiner* — Robert Stodola
(74) *Attorney, Agent, or Firm* — Brinks Gilson & Lione; G. Peter Nichols

(57) ABSTRACT

A container for containing a liquid or pasty material which is combined with a system for collecting and dispensing without taking in air. The container is rigid and includes a flexible bag which contains the material to be dispensed and which is combined with the collecting system. The bag is produced separately from the rigid container and has an overall cylindrical reservoir which is open at the top portion thereof and which is divided into four areas defined by a rigid upper sidewall, a flexible deformable lower sidewall, and a fillet connecting the flexible side wall to a base.

10 Claims, 3 Drawing Sheets

(56) References Cited

U.S. PATENT DOCUMENTS

| | | | | |
|---|---|---|---|---|
| 6,253,936 | B1 * | 7/2001 | Kong | 215/11.3 |
| 8,579,158 | B2 * | 11/2013 | Rice | 222/95 |
| 2006/0226171 | A1 | 10/2006 | Sternberg | |

FOREIGN PATENT DOCUMENTS

| | | | | |
|---|---|---|---|---|
| FR | 811 137 | | 4/1937 | |
| GB | 477068 | A * | 12/1937 | B65D 83/0055 |
| GB | 2 184 491 | | 6/1987 | |
| GB | 2 253 387 | | 9/1992 | |
| JP | H 11301693 | | 11/1999 | |
| WO | WO 93/14021 | | 7/1993 | |
| WO | WO 2006/107403 | | 10/2006 | |

OTHER PUBLICATIONS

PCT/FR2013/050249 Written Opinion of the International Search Authority dated May 31, 2013 (7 pages).

PCT/FR2013/050249 International Preliminary Report on Patentability dated Sep. 16, 2014 (8 pages).

* cited by examiner

CONTAINER, IN PARTICULAR A WIDE-MOUTHED JAR, FOR CONTAINING A LIQUID OR PASTY MATERIAL AND COMBINED WITH A SYSTEM FOR COLLECTING AND DISPENSING WITHOUT TAKING IN AIR

This application claims priority to International Application No. PCT/FR2013/050249 filed Feb. 6, 2013 and French Patent Appln. No. 1252358 filed Mar. 15, 2012; the entire contents of each are incorporated herein by reference.

TECHNICAL FIELD

The present invention relates to a container intended to contain a liquid or pasty material, associated with a system for collecting and dispensing without taking in air, called "Airless", said container being rigid and having a flexible bag holding the material to be dispensed, and being associated with the collecting system.

PRIOR ART

A first known technique for making such containers consists of obtaining, by molding, a rigid flask and a flexible bag, in a single operation or in several operations.

But these flasks, commonly called "bag flasks", have a height greater than their diameter, and collapsing of the bag occurs laterally, because it is the sides of the jar that have the greatest surface area and that collapse.

This technique is therefore not suited to jars, for cosmetics for example, which are wider than they are high and have a large-diameter opening, close or identical to that of the jar itself.

Thus it is demonstrated that the technology of "bag flasks" is not applicable to a jar intended to be "Airless" because the flasks are in principle blow-molded, with a neck that is smaller in diameter than the body of the flask, which is not the case with jars where the opening diameter is large, and it is not known how to make bag type "Airless" containers for 15 ml and 30 ml jars and for 200 ml jars, with non-standard blowing ratios.

The solutions proposed and described in documents EP0546898 and GB2184491 related to bags containing the material, the outlet neck whereof has a diameter smaller than the diameter of the bag body, which is necessarily obtained by blow-molding. These solutions therefore do not apply to large-diameter bags with large openings.

A second well-known technique is to make piston-type "Airless" flasks. But these are not compact, due to the thickness needed for the piston to operate, and require the development of a new line of jars. It is not possible to make piston-type "Airless" jars for large diameter 200 ml jars, molding tolerances making fits and seals difficult over large diameters.

Thus the problem of making containers, particularly large-diameter jars with wide openings, which must be associated with an "Airless" piston type jar, remains as before.

DESCRIPTION OF THE INVENTION

According to a first phase of the inventive approach, this consists of seeking a compromise between the "Airfree" technique and the "Piston" technique, that is a container having both a flexible bag and an associated piston, so as to obtain an "Airless" system suited to a large-diameter container according to the object being sought.

To this end, the invention relates to a container intended to contain a liquid or pasty material, associated with a system for collecting and dispensing without taking in air, said container being rigid and including a flexible bag containing the material to be dispensed, and associated with the collecting system, characterized in that the bag is obtained by plastic injection independently of the rigid container and constitutes a generally cylindrical reservoir, having at its upper part a large opening with a diameter equal to its inner diameter, said bag consisting of four areas consisting of:

- a rigid upper sidewall the upper end edge whereof is intended to cooperate in an airtight manner between the neck of the container or the edge of an optional rigid bowl, a corresponding flange of a lid of the associated dispensing system and a lower peripheral end edge whereof of said area constitutes a rigid band providing the connection with
- a flexible and deformable lower sidewall, with an inner diameter identical to that of the upper rigid sidewall and the concentricity whereof is provided by the rigid band, to extend axially from it toward
- a fillet or chamfer constituting a connecting and articulating area between the lower flexible sidewall and
- a rigid bottom with a diameter smaller than the diameter of the reservoir thus formed, said edge, when subjected to vacuum signal by the collecting system, being drawn upward in the manner of a piston, driving the connecting and articulating area as well as the flexible wall in folding back over itself.

The advantages of such a container are the following:

- a compact "Airless" reservoir which can be incorporated into existing reservoirs,
- possibility of operating with a low vacuum (10 mbar to 50 mbar) collecting device requiring little energy to be contributed by the user,
- a good material retrieval rate (>95%) and good compatibility with very viscous cremes in the jars. The bottom moves to push the material toward the collecting device, which allows operation with very viscous materials.
- a large opening diameter identical to that of the jar, which facilitates filling.

The present invention also relates to features that will be revealed in the course of the description that follows, and which will need to be considered in isolation or in all their possible technical combinations.

This description, given by way of a non-limiting example, will make it easier to understand how the invention can be implemented, with reference to the appended drawings wherein:

DETAILED DESCRIPTION

Figure 1:
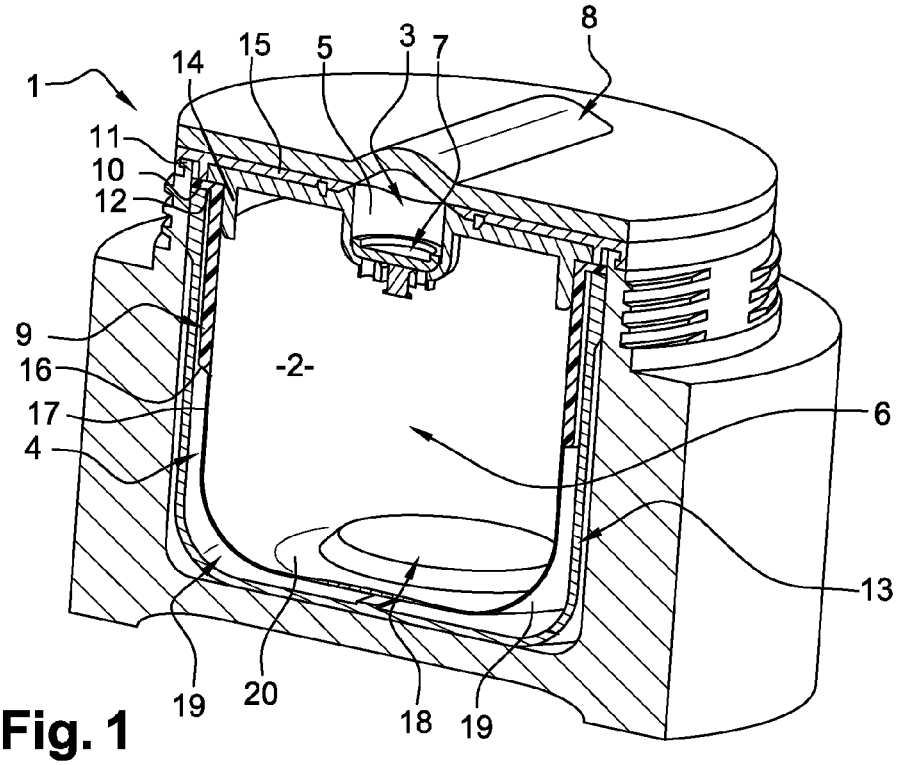
FIG. 1 shows a perspective and section view of an "Airless" container and of a collection and dispensing system according to the invention, with a full bag.
Figure 2:
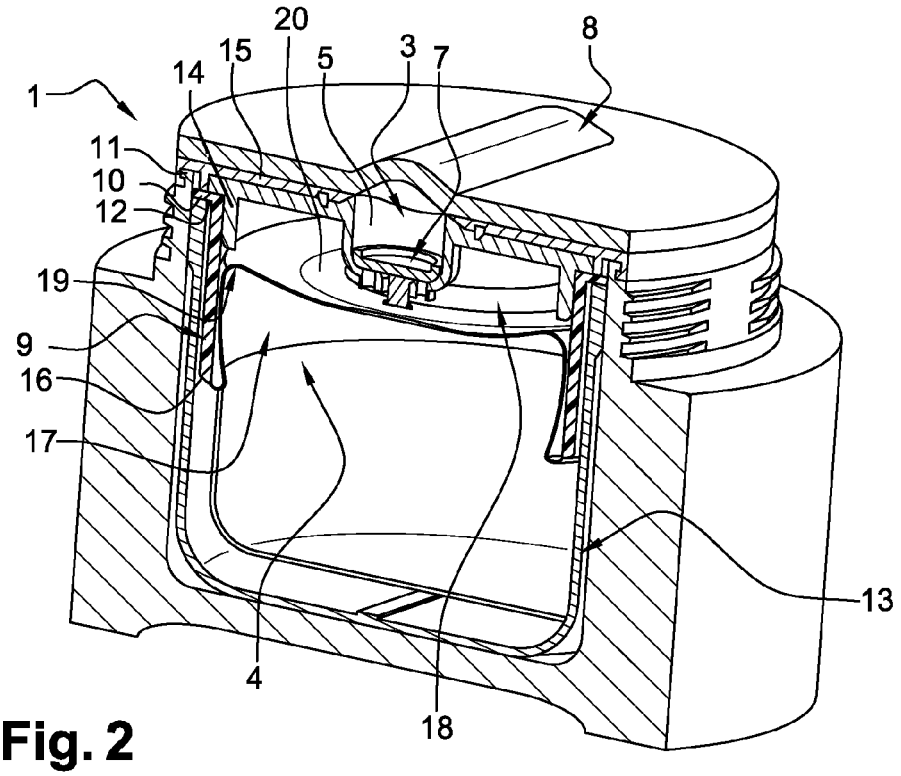
FIG. 2 shows a perspective and section view of an "Airless" container according to the invention, with an empty bag.
Figure 3:
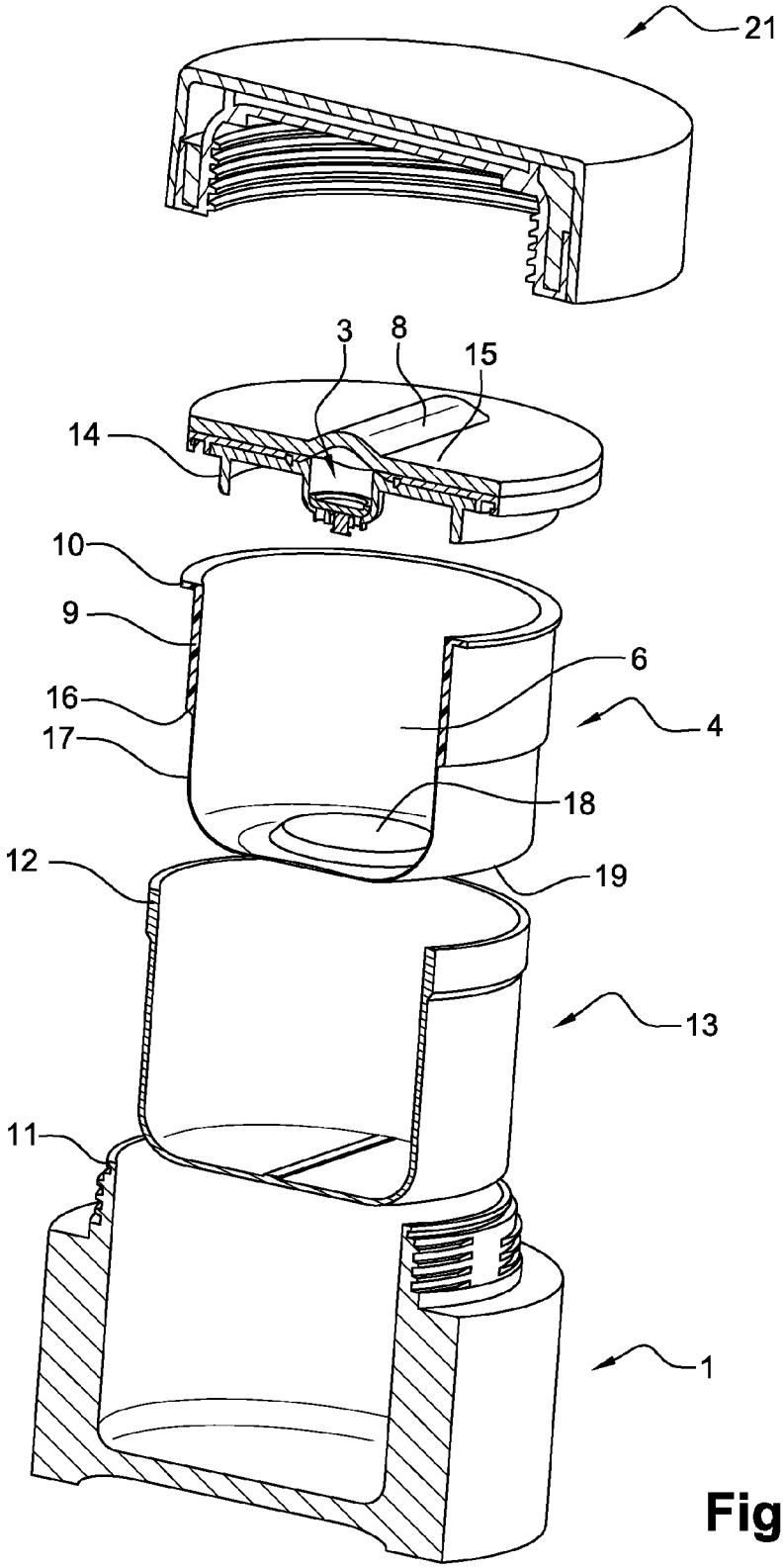
FIG. 3 shows an exploded perspective view of the container according to FIG. 1.
Figure 4:
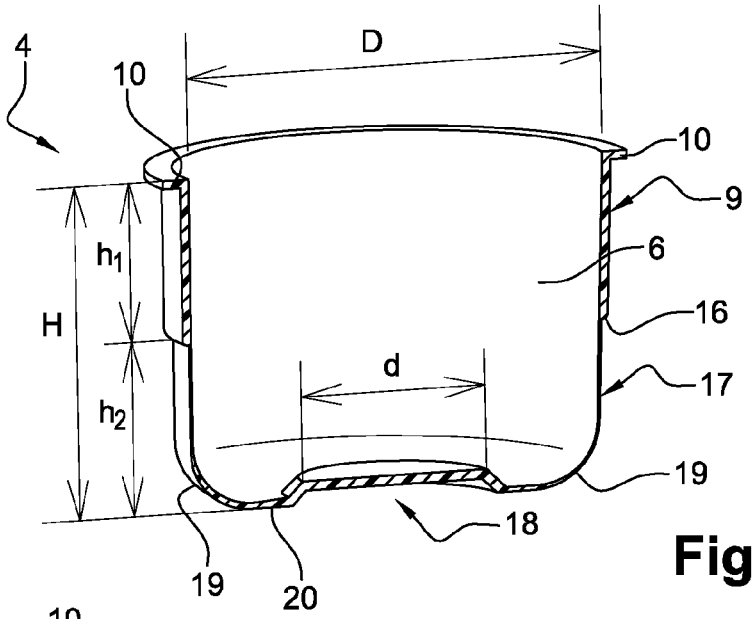
FIG. 4 shows an axial section view of a bag according to the invention.
Figure 5:
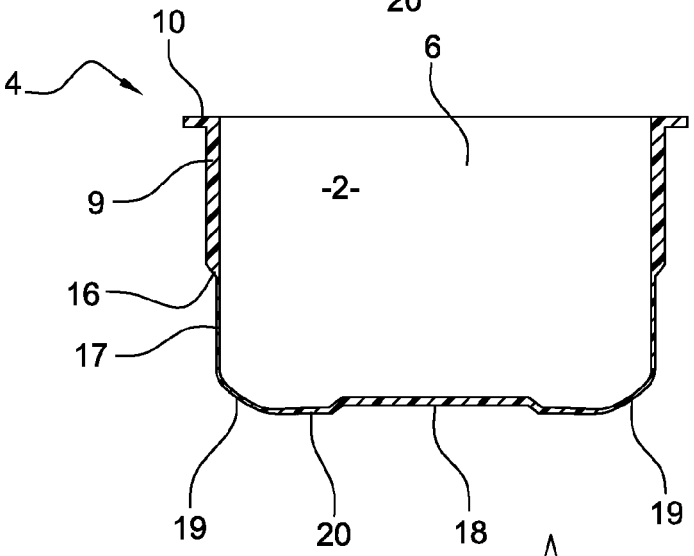
FIGS. 5 and 6 show, at reduced scale, schematically and by comparison with FIGS. 1 and 2, a bag according to FIG. 4, respectively full and emptied of its material.
Figure 6:
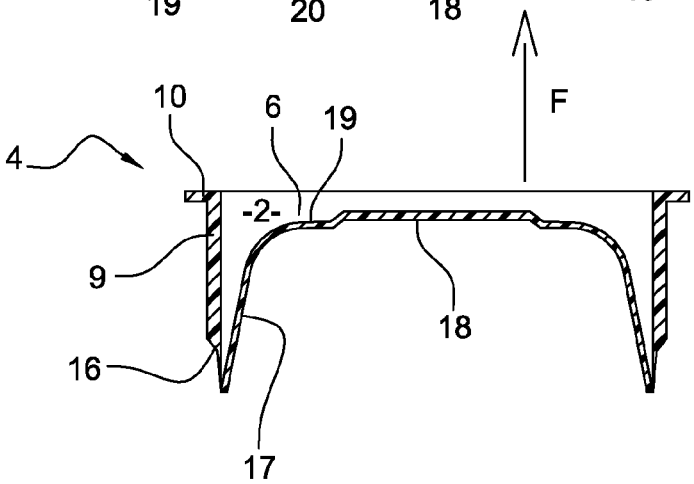

The container with the overall designation of 1 in the figures is intended to contain a liquid or pasty material 2. It is associated with a system 3 for collecting and dispensing without taking in air, said container 1 being rigid and including a flexible bag 4 holding the material to be dispensed 2, and which is associated with the collecting system 3.

The collecting and dispensing system 3 consist of a dosing chamber 5, communicating on the one hand with a reservoir 6 constituted by the bag 4, through a non-return valve 7, and on the other hand with an outside channel 8, made of elastically deformable material, or any other means for dispensing the material 2.

According to the invention, the bag 4 is obtained by plastic injection independently of the rigid container 1 and constitutes a generally cylindrical reservoir 6, having at its upper part a wide opening with a diameter equal to its internal diameter, said bag consisting of four areas constituted by:

- a rigid upper sidewall 9, the upper end peripheral free edge 10 whereof is intended to cooperate in an airtight manner with a corresponding flange 14 of a cover 15 of the associated dispensing system 3, and of which one lower end peripheral edge of said area 9 constitutes a rigid band 16 providing a connection with
- a flexible and deformable lower sidewall 17, with an inner diameter identical to that of the rigid upper sidewall and the concentricity whereof is ensured by the rigid band 16, to extend axially from it toward
- a fillet or a chamfer 19 constituting a connection and articulation area between the flexible and deformable lower sidewall 17 and
- a rigid bottom 18 with a diameter "d" less than the diameter "D" of the reservoir 6 thus constituted, said bottom, when subjected to a vacuum signal "F" by the collecting system 3, being pulled upward in the manner of a piston, driving the connection and articulation area 19 as well as the flexible wall 17 in folding back over itself.

The container 1 is provided at its upper end with threads 11 that cooperate with threads provided on an outer cover 21. The container defines an inner volume that can receive an optional rigid bowl 13 that has an upper sidewall 12 with a top surface edge that cooperates with the peripheral free edge 10 of the sidewall 9 of the flexible bag 4.

Tests have demonstrated that good results were obtained when, on the one hand, the rigid upper sidewall 9 of the cylindrical reservoir 6 covers substantially half "h1" of the height "H" of this and its thickness and that of the bottom 18, are from about 0.8 to 2 mm, and when on the other hand the flexible lower sidewall 17 of the cylindrical reservoir 6 covers substantially half "h2" of the height "H" of this and extends into the fillet or chamber 19 and into a horizontal plane 20 concentric with the rigid bottom 18, and that its thickness is from about 0.05 to 0.35 mm.

A bag 4 thus constituted can, if it is suitably dimensioned of course, be adapted to any container, jar or tube, with a capacity of 10 ml to 2,000 ml, to make them "Airless" in association with an "Airless" collecting and dispensing system 3 which closes the top of the jar- or tube-type container.

The operation of such an assembly is as follows: under the influence of the "Airless" (without intake of air) collecting and dispensing system 3, a dose of material 2 is discharged outside the container 1, causing a vacuum inside the reservoir 6 because the dose to be discharged outside of the system 3 is not replaced with air. The reservoir 6 experiences a vacuum and compensates for the vacuum by a flexible deformation of its geometry.

During this vacuum action, which can be weak (from 10 mbar to 50 mbar), the rigid bottom 18 is sucked upward, in the manner of a piston, consequently driving the flexible sidewall 17 to deform upward, by folding and rolling back over itself, inside the reservoir 6. The vertical displacement of the rigid bottom 18, associated with the deformation of the flexible sidewall 17, causes a reduction in the volume of the reservoir 6, thus allowing discharge of the material 2 without intake of air.

Moreover, the flexible peripheral articulation area 19 forming a corner fillet, connected to the rigid bottom 18 on the one hand and to the flexible lower sidewall 17 on the other hand, makes it possible for the flexible lower sidewall 17 to fold over itself during the upward movement of the piston as aforesaid. This articulation area 19 makes it possible to initiate and to facilitate the turnover of the flexible sidewall 17 onto itself, then to drive this turnover through the upward displacement of the rigid bottom 18 forming a piston, up to the moment that the fold formed by this turnover reaches the rigid upper sidewall 9, thus blocking displacement of this turnover and of the rigid bottom 18.

At the end of the discharge, the flexible lower sidewall 17 is completely turned over itself and it is raised so as to cover the same height h1 as the rigid sidewall 9. The rigid bottom or piston 18 is then situated at the very top of the reservoir.

The fillet can be straight or rounded.

The half-rigid, half-flexible bag 4 is obtained in a single piece in the course of one and the same molding operation, by plastic injection.

In practice, to be able to form fine thicknesses of 0.2 mm by injection, highly fluid materials and injection machines with high injection pressures, high injection speeds and mold closing force which can vary in the course of the injection cycle are used.

By way of an example, the materials used for making the bag can be LDPE "low density polyethylene" or EVA (ethylene vinyl acetate) or TPE (thermoplastic elastomer) or PU (polyurethane), having very low elastic moduli (<300 MPa) associated with very high fluidity (MFI fluidity>50 g/10 mn of material passing through a calibrated die under 2.16 kg of load and at a temperature of 190° C.).

Injection will be carried out at high speed and high pressure, with a closed mold with a very high or variable mold closing force.

The invention claimed is:

1. A container for holding a liquid or pasty material suitable for a collecting and dispensing system without taking in air wherein the container is rigid and includes a one-piece flexible bag containing the material to be dispensed and which is associated with the collecting system, the bag defining a generally cylindrical reservoir and comprising:

- an opening with a diameter equal to an inner diameter of the bag;
- a rigid upper sidewall with (i) an upper end having a peripheral free edge that cooperates in an airtight manner between a neck of the container and a corresponding flange of a cover of the associated dispensing system and (ii) a lower end having a peripheral edge that constitutes a rigid band;
- a flexible and deformable lower sidewall having an inner diameter identical to that of the rigid upper sidewall and a concentricity defined by the rigid band, the flexible and deformable lower sidewall extending axially from the rigid band;
- a fillet or a chamfer that provides a connection and articulation area between the flexible and deformable lower sidewall and a rigid bottom, wherein the rigid bottom has a diameter that is smaller than a diameter of the reservoir, such that the bottom, when subjected to a vacuum signal by the collecting system, is drawn upward driving the connection and articulation area as well as the flexible sidewall to fold back over itself.

2. The container according to claim 1, wherein the rigid upper sidewall covers substantially half of a height of the reservoir.

3. The container according to claim 1, wherein the flexible lower sidewall covers substantially half of a height of the reservoir and extends into the fillet or chamfer and into a horizontal plane concentric with the rigid bottom.

4. The container according to claim 1, wherein the bag is formed independently of the container.

5. The container according to claim 4, wherein the bag is formed in one piece during a single plastic injection molding operation.

6. The container according to claim 1, wherein the bag is formed from a material having high fluidity and low elastic modulus and being selected from the group of low density polyethylene, ethylene vinyl acetate, thermoplastic elastomer, or polyurethane.

7. The container of claim 1 wherein the collecting and dispensing system further comprises a non-return valve extending into the reservoir; and an outside channel that is opposite the non-return valve and from which material is expelled.

8. The container of claim 7 further comprising a dosing chamber disposed between the non-return valve and the outside channel.

9. The container of claim 7 further comprising a cover that restricts access to the dispensing system.

10. The container of claim 7 further comprising a cover that restricts access to the outside channel.

* * * * *